United States Patent [19]

Mack

[11] Patent Number: 4,582,112

[45] Date of Patent: Apr. 15, 1986

[54] WEIGHT-CONTROLLED CASTING OF FULLY-KILLED STEEL INGOTS

[75] Inventor: Jay O. Mack, Pittsburgh, Pa.

[73] Assignee: United States Steel Corporation, Pittsburgh, Pa.

[21] Appl. No.: 471,950

[22] Filed: Mar. 3, 1983

[51] Int. Cl.[4] ..... B22D 7/10

[52] U.S. Cl. ..... 164/133; 164/137; 164/DIG. 6; 249/197; 249/106; 249/DIG. 5

[58] Field of Search ..... 164/123, 137, 4.1, DIG. 6, 164/133; 249/197, 198, 199, 200, 201, 202, 106, DIG. 5

[56] References Cited

U.S. PATENT DOCUMENTS

| | | | |
|---|---|---|---|
| 1,508,931 | 9/1924 | Gathmann | 249/DIG. 5 |
| 2,183,576 | 12/1939 | Lindemuth | 164/123 |
| 2,946,103 | 7/1960 | Vallak | 249/197 |
| 3,208,116 | 9/1965 | Gathmann | 249/DIG. 5 |
| 4,470,445 | 9/1984 | Mangan et al. | 164/156 |

FOREIGN PATENT DOCUMENTS

| | | | |
|---|---|---|---|
| 12065 | 4/1915 | United Kingdom | 249/106 |

*Primary Examiner*—Kuang Y. Lin

*Attorney, Agent, or Firm*—Arthur J. Grief

[57] ABSTRACT

In the ingot casting of killed-steel steels, insulative walled reservoirs known as hot-tops are employed at the top of the mold to maintain a source of molten steel which can feed the shrinkage cavity that forms during solidification of the ingot. Presently, these hot-tops are set to a predetermined height prior to the filling of the mold cavity. As a result of such controlled height pourings, variations in the volume of the mold cavity lead to significant losses in the ingot-to-product yield. To overcome such losses, the invention employs a floating hot-top. Rather than teeming to a prescribed height, the ingot is teemed to a prescribed weight and the floating hot-top is placed on the surface of the steel so teemed. Further pouring is delayed, at least until the hot top is welded to the surface by the freezing of the molten steel in contact therewith. Thereafter, the hollow center of hot-top is filled to provide a sufficient reservoir of molten metal for the resultant shrinkage cavity.

3 Claims, 4 Drawing Figures

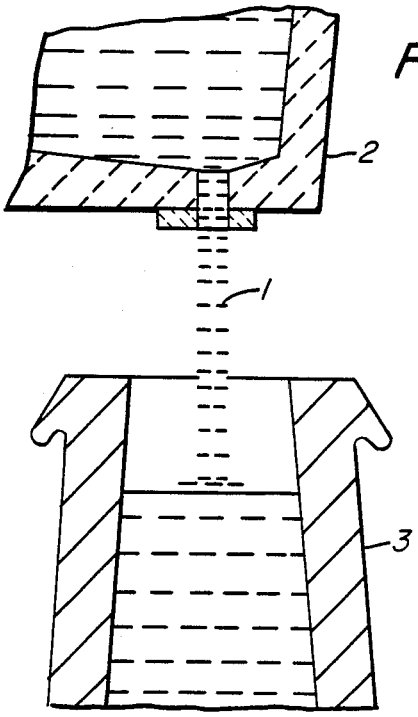
FIG. 1
FIG. 2
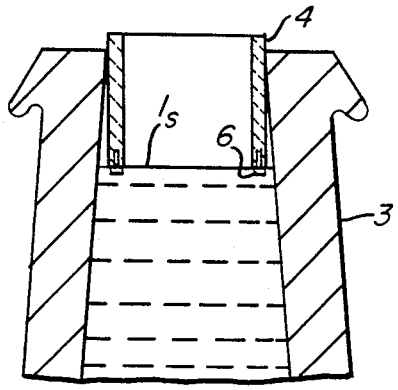
FIG. 3
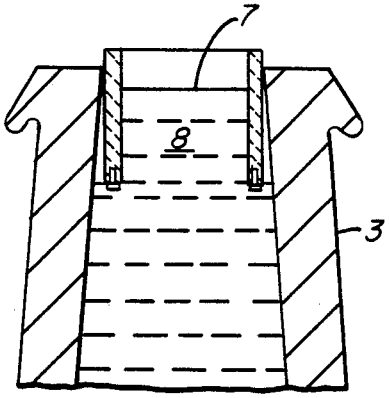
FIG. 4
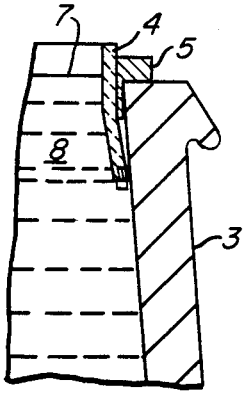

WEIGHT-CONTROLLED CASTING OF FULLY-KILLED STEEL INGOTS

This invention relates to the pouring (teeming) of steel into ingot molds, and is more particularly related to the use of a new type of hot-top for confinement of the pipe cavity, formed during the solidification of fully-killed steel, entirely to the hot-top portion.

When molten steel begins to solidify, the solubility of gases dissolved in the steel decreases and the excess gases are expelled from the metal. The amount of gases dissolved in the liquid steel and the amount of gases released during solidification determine the type of ingot which is formed. Thus, ingot structures range from that of a fully-killed or dead-killed ingot to that of a violently rimming ingot—the differences being the result of the amount of gas evolved from these ingots as they solidify. In fully-killed ingots, essentially no gas is evolved. As a result thereof, as the steel begins to solidify, the top surface thereof becomes concave, forming a shrinkage cavity that is commonly called "pipe," located in the upper central portion of the ingot. To achieve production of a sound ingot, i.e. freedom from pipe, the art has employed various types of hot-tops inserted into or on top of the mold and supported at various heights, depending on the length and required weight of the main body of the ingot. The refractory or insulative material with which the hot-top is constructed or lined absorbs heat at a rate less rapidly than that of the cast iron mold, so that the top of the ingot within the hollow center of the hot-top remains molten until the remainder of the ingot has solidified—furnishing an overlying pool of molten steel that feeds down into the portions of the ingot below the hot-top to fill the shrinkage cavity which forms.

Hot-tops may be constructed of insulative or exothermic materials and are of three basic types: (i) sideboards fastened to the inside surfaces at the top of the mold, generally used for big end down (BEU) molds, (ii) adjustable hot-tops, sized to fit partway down into a BEU mold, with mechanical means to control the distance projecting down into the mold, and (iii) set-on hot-tops, placed to lie on top of the ingot mold itself. In all these cases, placement of the hot-top is predicated on providing a full amount of usable steel from the lightest potential weight of the entire ingot weight population. Consequently, the heavier weight ingots in the ingot weight population contain excess steel that must be discarded during shearing and trimming in the downstream manufacturing operation, resulting in a significant loss of yield between teeming and product production. In commercial operations, variation of ingot weight population generally amounts to ±3 to ±5% of the overall average ingot weight of the population. Such variation of ingot weight within the populations result from two basic factors; a differing initial cavity volume in new molds, due to variables in mold manufacturing and a further modified cavity volume resulting after use of the mold, because of changes in mold material density, or because of erosion, other deterioration or repair of the internal mold surfaces.

Many products such as plates, structurals and tube rounds require specific semi-finished product weights (or sizes) to maximize semi-finished to finished product yields without producing undersize pieces and without excessive discard and/or trimming losses. Attempting to minimize such yield losses, the art presently utilizes pour-height control and is restricted to this type of control due to current methods for installing the hot-tops. As a result of such pour-height control, accompanying yield losses result from the above-noted variability of the cavity volume. Such losses could, of course, be minimized by controlling the ingot weight. This method of control is readily achievable for ingots produced from open-top big-end-down molds by the use of weighing devices, such as those associated with the ladle suspension system that can measure or control the amount of liquid steel teemed with the open-top big-end-down mold, or by the use of statistical methods to predict the pour height needed in the next pour into the mold to achieve a specified ingot weight.

It has now been found that pour-weight control can be adapted to hot-top ingots by utilizing a floating hot-top, in which the main ingot body is initially poured to the prescribed weight—determined from the downstream weight requirements. The floating hot-top is thereafter placed on top of the molten steel and further pouring is delayed while the hot-top is frozen into place. Thereafter, the hot-top cavity is filled to provide the molten reservoir for filling the shrinkage cavity that develops in the top of the ingot during solidification.

The advantages of the instant invention will become more apparent from a reading of the following description when read in conjunction with the appended claims and the figures, in which:

BRIEF DESCRIPTION OF THE DRAWINGS

FIGS. 1 through 3 are illustrative of the consecutive steps performed in accord with the instant method.

FIG. 4 shows an alternative or supplemental lateral support to overcome the forces exerted by the molten steel in the hot-top.

Referring to FIG. 1, molten steel 1 is introduced from a vessel such as a ladle 2 into ingot mold 3 which may be of the big end down (BED) shown in FIG. 1, or of the big end up (BEU) type (not shown). When the amount of steel poured reaches a predetermined weight—controlled by a weighing device or a statistically based system (not shown) that permits reliable control of the weight of the steel teemed, pouring is halted for this specific ingot. A floating hot-top 4 (FIG. 2) composed of a heat-loss preventive material (i.e. insulative or exothermic material) is then placed on the top surface 1*s* of the molten steel in the mold.

The hot-top 4 illustrated in FIG. 2 shows the use of a box-like assembly designed in a size suitable for easy insertion into the top of the ingot mold, and light enough to float on the surface, 1*s* of liquid metal so as not to appreciably displace the molten steel beneath it. The assembly could of course be inserted into the top of the mold as individual pieces, or as subassemblies consisting of 2–4 walls, with or without partial or complete closure on the bottom to assist in placement or for structural stability of the assembly. The one-piece structure or the individual wall pieces are designed to fit loosely against the inside surfaces of the mold wall in the case of BED molds or against the inside surfaces of the hot-top in the case of BEU molds. Lateral support will preferably be provided by the inside surface of the mold wall or hot-top wall itself during the filling of the hot-top, FIG. 3, such support being developed by the pressure of the metal in the reservoir, forcing the hot-top walls against the mold walls. Supplementary lateral support, FIG. 4, can be provided for those cases where the liquid level is above the top of the mold or hot-top extension by a continuous peripheral structure or a series of blocks 5 with or without attached shims that fit between the floating hot-top and the mold wall or hot-top insert wall. To effectuate the freezing into position of the floating hot-top, the bottom edges 6 and/or corners of the hot-top may be fitted with heat-absorbing inserts, e.g. nails, which would accelerate the welding into place of the molten metal below it. After fixation, e.g. by freezing has been achieved, additional molten metal 4, in an amount at least sufficient in volume to fill the potential shrinkage cavity, is poured into the hollow center of the hot-top, preferably only to a level 7 at which the walls 4 of the hot-top benefit from lateral support. To insure that the steel in reservoir 8 will remain molten for a time sufficient to fill the pipe, a heat-loss preventive cover may be placed on the top surface of the liquid steel.

I claim:

1. In the production of killed-steel ingots, wherein steel is teemed into a mold cavity to effect solidification therein, such solidification resulting in the formation of a shrinkage cavity in the upper central portion of the ingot, and a hot-top lined with a heat-loss preventive material is utilized so that the top portion of the ingot remains molten for a longer period than the main body of the ingot whereby said top portion may furnish a pool of molten steel to fill the shrinkage cavity in the main body portion below said hot-top, the improvement for preventing loss of ingot-to-product yield, due to variations in the volumes of the mold cavity, which comprises, (a) teeming a predetermined weight of steel into the mold, said weight being determined by the downstream weight requirements of the production line, (b) placing an annular-shaped hot-top on the top surface of the steel in the mold, said hot-top having a density low enough so as to not appreciably displace molten steel beneath it and force such steel into the hollow center of the annular hot-top said hollow center having an internal volume greater than that required to fill the resulting shrinkage cavity, (c) after the steel has frozen along the points where the bottom surface of said hot-top contacts the top surface of the steel, resuming the teeming of steel into the hot-top hollow center, in an amount sufficient to fill the shrinkage cavity below said hot-top.

2. The method of claim 1, wherein steel is teened into said hot-top hollow center in an amount which does not rise substantially above the portion of the hot-top which is laterally supported on its outer surface.

3. The method of claim 2, wherein after step (c), a heat loss preventive cover is placed on the top surface of the steel in the hollow center.

* * * * *